US007235931B2

(12) United States Patent
Matsushima et al.

(10) Patent No.: US 7,235,931 B2
(45) Date of Patent: Jun. 26, 2007

(54) DISCHARGE LAMP LIGHTING APPARATUS FOR LIGHTING MULTIPLE DISCHARGE LAMPS

(75) Inventors: Mitsuo Matsushima, Iwata-gun (JP); Kohei Nishibori, Iwata-gun (JP); Hiroshi Shinmen, Iwata-gun (JP)

(73) Assignee: Minebea Co., Ltd., Nagano (JP)

( * ) Notice: Subject to any disclaimer, the term of this patent is extended or adjusted under 35 U.S.C. 154(b) by 57 days.

(21) Appl. No.: 11/132,387

(22) Filed: May 19, 2005

(65) Prior Publication Data

US 2006/0017399 A1 Jan. 26, 2006

(30) Foreign Application Priority Data

Jul. 9, 2004 (JP) ..... 2004-203317

(51) Int. Cl.
*H05B 37/00* (2006.01)

(52) U.S. Cl. ..... 315/240; 315/241 R; 315/242; 315/243

(58) Field of Classification Search ..... 315/240, 315/241 R, 242, 243
See application file for complete search history.

(56) References Cited

U.S. PATENT DOCUMENTS 5,410,466 A * 4/1995 Maehara ..... 363/98
5,512,801 A * 4/1996 Nilssen ..... 315/209 R

FOREIGN PATENT DOCUMENTS

JP A 11-260580 9/1999

* cited by examiner

*Primary Examiner*—David Vu
(74) *Attorney, Agent, or Firm*—Oliff & Berridge, PLC

(57) ABSTRACT

In a discharge lamp lighting apparatus to light two discharge lamps, one terminal of the secondary side of a step-up transformer is connected to one terminal of each of the two discharge lamps, the other terminal of each of the two discharge lamps is connected, via each of two variable inductance elements, to one lamp current detecting unit, a signal of each lamp current detecting unit is connected to a lamp current control circuit, and an output signal from each lamp current control circuit is connected to each variable inductance element so as to vary the inductance of each variable inductance element, whereby the lamp current flowing through each discharge lamp is controlled.

11 Claims, 3 Drawing Sheets

PRIOR ART

DISCHARGE LAMP LIGHTING APPARATUS FOR LIGHTING MULTIPLE DISCHARGE LAMPS

BACKGROUND OF THE INVENTION

1. Field of the Invention

The present invention relates to a discharge lamp lighting apparatus, and more particularly to a discharge lamp lighting apparatus to light a plurality of discharge lamps for use as a backlight in a liquid crystal display (LCD) apparatus.

2. Description of the Related Art

An LCD apparatus, which is a flat panel display apparatus, is used in various applications. Since a liquid crystal in the LCD apparatus does not emit light by itself, a lighting device is required in order to achieve a good display. A backlight device to light a liquid crystal panel from behind is among such lighting devices. In the backlight device, a cold cathode lamp is mainly used as a discharge lamp, and a discharge lamp lighting apparatus including an inverter to drive the cold cathode lamp is provided.

Recently, the LCD apparatus is becoming larger and larger for use in, for example, a large-screen TV, and therefore a number of discharge lamps are used in a backlight device in order to achieve sufficient screen brightness for the LCD apparatus. In such a backlight device, if variation exists in brightness of the discharge lamps, the display screen of the LCD apparatus incurs non-uniformity thus significantly degrading the display quality. So, not only high luminance of each discharge lamp but also brightness uniformity of all discharge lamps is required. Further, cost reduction of the discharge lamp lighting apparatus is requested along with the price reduction of the LCD apparatus.

The brightness variation of the discharge lamps can be prevented by equalizing lamp currents flowing respective discharge lamps for achieving a uniform brightness. Lamp currents can be equalized by a method such that transformers which are provided in a number equal to the number of the discharge lamps are individually controlled by respective control IC's. This approach, however, requires an increased number of components thus pushing up cost, which eventually results in an increased cost of the discharge lamp lighting apparatus.

Lamp currents can alternatively be equalized by providing balance coils, but this alternative approach requires a large number of balance coils for multiple discharge lamps, and the balance coils must be designed individually with different specifications because the values of currents flowing through the balance coils differ from one another depending on the places where the balance coils are disposed. Consequently, the number of components is increased pushing up the cost on the discharge lamp lighting apparatus.

A discharge lamp lighting apparatus as still another approach is proposed, in which inductance values are controlled by variable inductance elements, rather than balance coils, so as to control respective lamp currents and reduce the variation in brightness of the discharge lamps for uniform brightness over the display screen (refer to, for example, Japanese Patent Application Laid-Open No. H11-260580).

FIG. 3 is a block diagram for a circuitry of a discharge lamp lighting apparatus which is disclosed in the aforementioned Japanese Patent Application Laid-Open No. H11-260580, and in which two discharge lamps are provided.

Referring to FIG. 3, switching elements (FET's) 102 and 103 are connected in series between the positive and negative electrodes of a DC power supply 101, and the connection portion of the source terminal of the switching element 102 and the drain terminal of the switching element 103 is connected to the negative electrode of the DC power supply 101 via a series resonant circuit 120A which includes a capacitor 122*a*, and a coil 121*a* of an orthogonal transformer 121A constituting an variable inductance capable of controlling inductance values, and also via a series resonant circuit 120B which includes a capacitor 122*a*, and a coil 121*a* of an orthogonal transformer 121B constituting an variable inductance.

The connection portion of the coil 121*a* of the orthogonal transformer 121A and the capacitor 122*a* is connected to the negative electrode of the DC power supply 101 via a series circuit including a capacitor 110*a*, a discharge lamp 111*a*, and a current detecting resistor 123*a* of a control circuit 123A, and an output signal of the control circuit 123A is sent to a control coil 121*b* of the orthogonal transformer 121A.

The control circuit 123A supplies a control current to the control coil 121*b* of the orthogonal transformer 121A, and is arranged such that the connection portion of the discharge lamp 111*a* and the current detecting resistor 123*a* is connected to the inverting input terminal of an operation amplifying circuit 123*c* via a rectifier diode 123*b*, the connection portion of the rectifier diode 123*b* and the inverting input terminal of the operation amplifying circuit 123*c* is connected to the negative electrode of the DC power supply 101 via a smoothing capacitor 123*d*, the non-inverting terminal of the operation amplifying circuit 123*c* is connected to the negative electrode of the DC power supply 101 via a battery 123*e* having a reference voltage Vref to determine a reference value of a current of the discharge lamp 111*a*, and that the output terminal of the operation amplifying circuit 123*c* is connected to the negative electrode of the DC power supply 101 via the control coil 121*b* of the orthogonal transformer 121A.

The control circuit 123A functions to control the current of the discharge lamp 111*a*. Specifically, the control circuit 123A operates such that, when the current of the discharge lamp 111*a* is to be increased, the control current of the control coil 121*b* of the orthogonal transformer 121A is increased so as to decrease the inductance value of the coil 121*a* of the orthogonal transformer 121A thereby increasing the resonant frequency $f_0$ of the series resonant circuit 120A thus decreasing the impedance of the series resonant circuit 120A at a driving frequency consequently resulting in an increase of a voltage generated across the both ends of the capacitor 122*a*, and such that, when the current of the discharge lamp 111*a* is to be decreased, the control current of the control coil 121*b* of the orthogonal transformer 121A is decreased so as to increase the inductance value of the coil 121*a* of the orthogonal transformer 121A thereby decreasing the resonant frequency $f_0$ of the series resonant circuit 120A thus increasing the impedance of the series resonant circuit 120A at a driving frequency consequently resulting in a decrease of a voltage generated across the both terminals of the capacitor 122*a*.

There is provided another circuit which includes another orthogonal transformer 121B, and which is constituted and functions identically with the above-described circuit including the orthogonal transformer 121A.

In the discharge lamp lighting apparatus shown in FIG. 3, a control circuit 104 fixedly sets a switching frequency of a control signal to be supplied to the switching elements 102 and 103 whereby the currents flowing through the discharge lamps 111*a* and 111*b* are controlled at a predetermined value without controlling the switching frequency, thus uniform brightness between the discharge lamps 111*a* and 111*b* is achieved without performing complicated frequency control at the control circuit 104.

A high voltage of about 1,500 to 2,500 V is required to turn on a cold cathode lamp, and a voltage of about 600 to 1,300 V must be applied to keep the cold cathode lamp lighted on. Accordingly, a power supply to supply such a high voltage is required in a discharge lamp lighting apparatus. Since the discharge lamp lighting apparatus shown in FIG. 3 is not provided with a step-up circuit, the DC power supply 101 has a circuitry to output a high voltage in order to duly turn on the discharge lamps 111*a* and 111*b*.

Also, since the switching elements 102 and 103 to turn on the discharge lamps 111*a* and 111*b*, and the control circuit 104 to control the switching elements 102 and 103 are connected to the DC power supply 101 to output a high voltage, the switching elements 102 and 103 and the control circuit 104 must be composed of high withstand voltage materials which are expensive thus pushing up the cost of the components, and eventually the cost of the apparatus.

Further, in the discharge lamp lighting apparatus shown in FIG. 3, the capacitors 110*a* and 110*b*, which are current controlling capacitors (so-called "ballast capacitors") to stabilize the lamp current of the discharge lamps 111*a* and 111*b*, are connected in series to the discharge lamps 111*a* and 111*b*, respectively, and a high voltage is applied to the capacitors 110*a* and 110*b*. Consequently, the capacitors 110*a* and 110*b* must also be composed of high withstand voltage materials, and since the current controlling capacitors must be provided in a number equal to the number of discharge lamps to be driven, the cost of the apparatus is pushed up definitely. Also, since a high voltage is applied to the capacitors 110*a* and 110*b* as described above, there is a problem also in terms of component safety.

SUMMARY OF THE INVENTION

The present invention has been made in light of the above problems, and it is an object of the present invention to provide a discharge lamp lighting apparatus, in which currents flowing through multiple discharge lamps are equalized for minimizing variation in luminance among the discharge lamps, and which can be inexpensively produced by restricting the number of high withstand voltage components.

In order to achieve the object described above, according to one aspect of the present invention, there is provided a discharge lamp lighting apparatus which comprising: a DC power supply; a control circuit; a step-up transformer defining a primary side and a secondary side; and switching elements connected to the DC power supply and functioning to drive the primary side of the step-up transformer by a signal from the control circuit thereby lighting at least two discharge lamps provided at the secondary side of the step-up transformer. In the discharge lamp lighting apparatus described above, one terminal of the secondary side of the step-up transformer is connected to one terminal of each of the at least two discharge lamps, and the other terminal of the secondary side of the step-up transformer is grounded; at least two series resonant circuits are each formed by a leakage inductance of the step-up transformer, and capacitors provided between the secondary side of the step-up transformer and each discharge lamp; at least two lamp current detecting units are each connected, via each of at least two variable inductance elements, to the other terminal of each discharge lamp; a signal of each of the at least two lamp current detecting units is connected to each of at least two lamp current control circuits; and an output signal from each lamp current control circuit is connected to each of the variable inductance elements so as to vary the inductance of each variable inductance element, whereby a lamp current flowing through each discharge lamp is controlled.

In the aspect of the present invention, a secondary winding of the step-up transformer may be split into at least two divisional windings, and each of the at least two series resonant circuits, each of the at least two variable inductance elements, each of the at least two lamp current detecting units, and each of the at least two lamp current control circuits may be provided at each of the at least two divisional windings of the secondary winding.

In the aspect of the present invention, each of the lamp current control circuits may include an operational amplifier and a transistor, a signal from each of the lamp current detecting units and a reference voltage may be inputted to the operational amplifier, an output of the operational amplifier may be connected to a base terminal of the transistor, and the collector terminal of the transistor may be connected to each of the variable inductance elements thereby varying the inductance of each variable inductance element.

In the aspect of the present invention, each of the variable inductance elements may constitute a transformer, and a snubber circuit may be connected to the both terminals of a control winding of the transformer.

In the aspect of the present invention, the discharge lamp lighting apparatus may be incorporated in a backlight device for a liquid crystal display apparatus.

According to the present invention, the currents flowing through the plurality of the discharge lamps are equalized thereby reducing the variation in brightness between the discharge lamps, and this can be achieved by using a limited number of additional circuit components with a high withstand voltage thus providing an inexpensive discharge lamp lighting apparatus.

And, the secondary winding Ns of the step-up transformer is split into a plurality of divisional windings, and the winding ratio between the divisional windings is changed so as to apply different voltages to the multiple discharge lamps, thus achieving desired lamp currents.

DETAILED DESCRIPTION OF THE PREFERRED EMBODIMENTS

Preferred embodiments of the present invention will hereinafter be described with the accompanying drawings.

Figure 1:
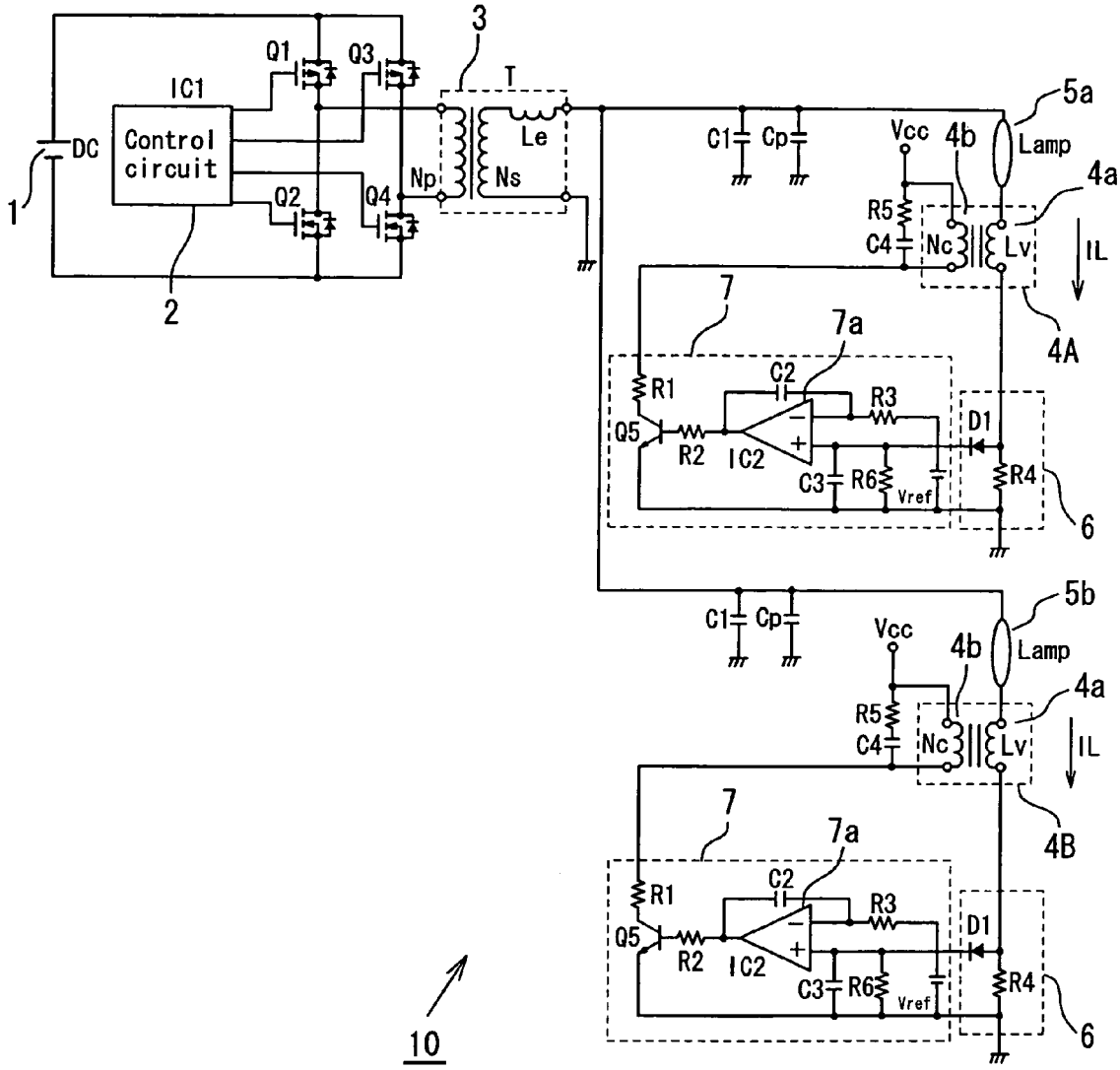
FIG. 1 is a circuitry of a discharge lamp lighting apparatus according to a first embodiment of the present invention.

Referring to FIG. 1, a discharge lamp lighting apparatus 10 according to a first embodiment of the present invention is adapted to drive discharge lamps 5*a* and 5*b*, for example, cold cathode tubes. In the discharge lamp lighting apparatus 10, a series circuit including transistors Q1 and Q2 as switching elements, and a series circuit including transistors Q3 and Q4 as switching elements are connected in parallel to both electrodes of a DC power supply 1, and the connection portion of the transistors Q1 and Q2 and the connection portion of the transistors Q3 and Q4 are connected respectively to both terminals of a primary winding Np of a step-up transformer 3, whereby what is called a full-bridge is constituted.

A control circuit 2 controls the discharge lamp lighting apparatus 10 and includes an oscillation circuit to set a driving frequency for driving the primary side of the step-up transformer 3, and the transistors Q1, Q2, Q3 and Q4 are switched on and off at a predetermined timing by output signals from the control circuit 2 thereby generating an AC voltage.

The primary side of the step-up transformer 3 is connected to the above-described full-bridge constituted by the transistors Q1, Q2, Q3 and Q4 in the present embodiment, but may alternatively be connected to a half-bridge. The full-bridge performs a switching operation more efficiently than the half-bridge and therefore is more preferable.

One terminal of a secondary winding Ns of the step-up transformer 3 is connected to one terminals of the discharge lamps 5*a* and 5*b*, and the other terminal of the secondary winding Ns of the step-up transformer 3 is grounded. Further description on the circuitry will be made with reference to a circuit including the discharge lamp 5*a*.

At the secondary side of the step-up transformer 3, a series resonant circuit is formed by a leakage inductance Le of the step-up transformer 3, and capacitors C1 and Cp. The capacitor C1 is connected to the circuit and adapted to adjust resonant frequency, and the capacitor Cp is a stray capacitance.

The other terminal (low tension side) of the discharge lamp 5*a* is connected to one terminal of a winding 4*a* of a transformer 4A, and a lamp current detecting unit 6 is connected to the other terminal of the winding 4*a*. The lamp current detecting unit 6 includes a lamp current detecting resistor R4 and a rectifier diode D1. A lamp current IL flowing through the discharge lamp 5*a* is converted into a voltage by the lamp current detecting resistor R4, and the voltage is rectified by the rectifier diode D1 which is connected to the connection portion of the winding 4*a* and the lamp current detecting resistor R4, and is outputted to the non-inverting input terminal of an operational amplifier 7*a* constituting a lamp current control circuit 7.

A reference voltage Vref is inputted to the inverting input terminal of the operational amplifier 7*a*, and the voltage rectified by the rectifier diode D1 is compared to the reference voltage Vref, and a resulting output is applied to the base of a transistor Q5. The collector terminal of the transistor Q5 is connected to a control winding 4*b* of the transformer 4A, the inductance value of the transformer 4A is controlled by fluctuation of the collector current of the transistor Q5, which fluctuates according to the output voltage of the operational amplifier 7*a*, that is to say, by fluctuation of a current flowing through the control winding 4*b*. A snubber circuit, which includes a capacitor C4 and a resistor R5 connected in series to each other, is connected in parallel to the control winding 4*b* of the transformer 4A in order to protect against a high spike voltage at the time of generation of back electromotive force.

The operation of the transformer 4A as a variable inductance element will be explained. The transformer 4A operates such that the inductance value decreases when the current value of the control winding 4*b* increases.

When the lamp current IL flowing through the discharge lamp 5*a* comes down below a predetermined value, the voltage of the lamp current detecting resistor R4 decreases. Accordingly, the output voltage of the operational amplifier 7*a* steps down, and the base current of the transistor Q5 decreases causing the collector current to decrease, too. Consequently, a current flowing through the control winding 4*b* of the transformer 4A decreases causing an inductance Lv of the transformer 4A to increase. As a result, the voltage applied to the discharge lamp 5*a* decreases, and the lamp current IL flowing through the discharge lamp 5*a*, which is a negative resistance, increases.

On the other hand, when the lamp current IL flowing through the discharge lamp 5*a* comes up above the aforementioned predetermined value, the voltage of the lamp current detecting resistor R4 increases. Accordingly, the output voltage of the operational amplifier 7*a* steps up, and the base current of the transistor Q5 increases causing the collector current to increase, too. Consequently, a current flowing through the control winding 4*b* of the transformer 4A increases causing the inductance Lv of the transformer 4A to decrease. As a result, the voltage applied to the discharge lamp 5*a* increases, and the lamp current IL flowing through the discharge lamp 5*a* decreases.

Here, a voltage $V_L$ across the both terminals of the winding 4*a* of the transformer 4A as a variable inductance element is expressed as follows:

$$V_L=\overline{\omega}\cdot Lv\cdot IL=2\pi f\cdot Lv\cdot IL \quad (1)$$

where Lv is the inductance of the transformer 4A, IL is the lamp current flowing through the discharge lamp 5*a*, and f is its operating frequency (angular frequency $\overline{\omega}$. If the inductance Lv of the transformer 4A as a variable inductance element is above a predetermined value, the inductance Lv is a dominant factor in the synthetic impedance composed of the impedance of the discharge lamp 5*a* and the inductance Lv of the transformer 4A, and the lamp current IL is determined mostly by the value of the inductance Lv. Accordingly, the inductance Lv of the transformer 4A performs the same function as a ballast capacitor, and a plurality of discharge lamps can be lighted in parallel.

A circuitry which includes the discharge lamp 5*b*, and which is connected in parallel to the secondary winding Ns of the step-up transformer 3 is identical with the above-described circuit including the discharge lamp 5*a*. The action of a lamp current IL flowing through the discharge lamp 5*b* is the same as the action of the lamp current IL flowing through the discharge lamp 5*a*, the operation of a transformer 4B as a variable inductance element is the same as the operation of the transformer 4A, and therefore their explanations will be omitted.

Thus, the inductance values of the variable inductance elements connected to respective low tension sides of the plurality of discharge lamps are controlled individually for each discharge lamp thereby changing the synthetic impedance composed of the impedance of the discharge lamp and the inductance of the variable inductance element so as to precisely control the lamp current of the discharge lamp. Consequently, the lamp currents of all the discharge lamps can be equalized resulting in a reduced variation in brightness of the discharge lamps.

And, the inductance Lv of the variable inductance element performs the same function as a ballast capacitor, and therefore a capacitor for limiting a current is not required. Consequently, the discharge lamp lighting apparatus can be produced without using additional circuit components with a high withstand voltage, contributing to reduction in production cost.

If the reference voltage Vref is set at a different value from one discharge lamp to another, the lamp current can be set at a different value from one discharge lamp to another. This setting is conducted in consideration of factors, such as temperature distribution in a backlight device, and the like, which influence the brightness of the discharge lamp.

In the present embodiment, the discharge lamp lighting apparatus 10 shown in FIG. 1 is to light two discharge lamps as an example, but can light more than two discharge lamps only if additional circuits each including a discharge lamp are connected in parallel at the secondary side of the step-up transformer 3.

Figure 2:
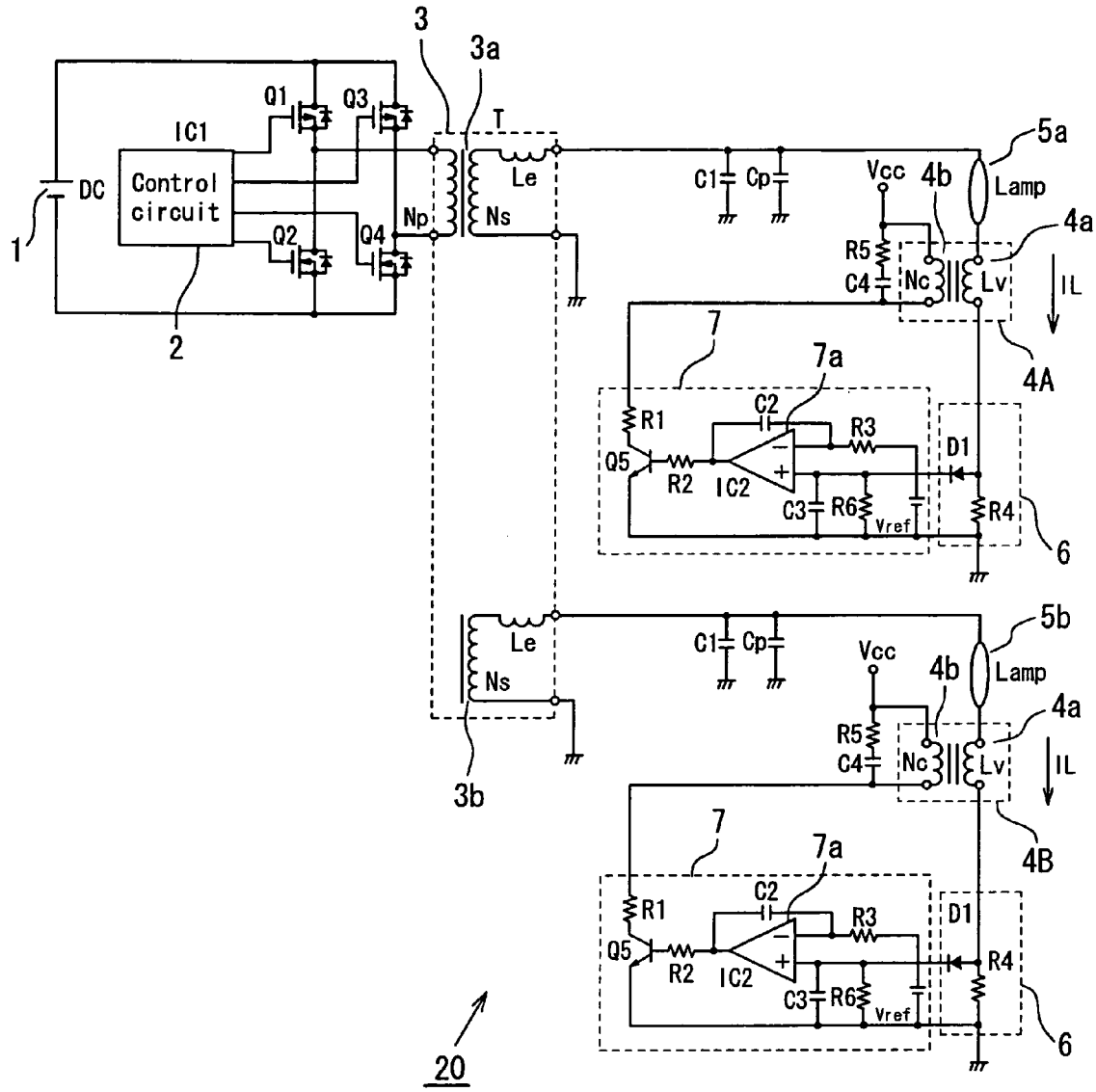
FIG. 2 is a circuitry of a discharge lamp lighting apparatus according to a second embodiment of the present invention.
Figure 3:
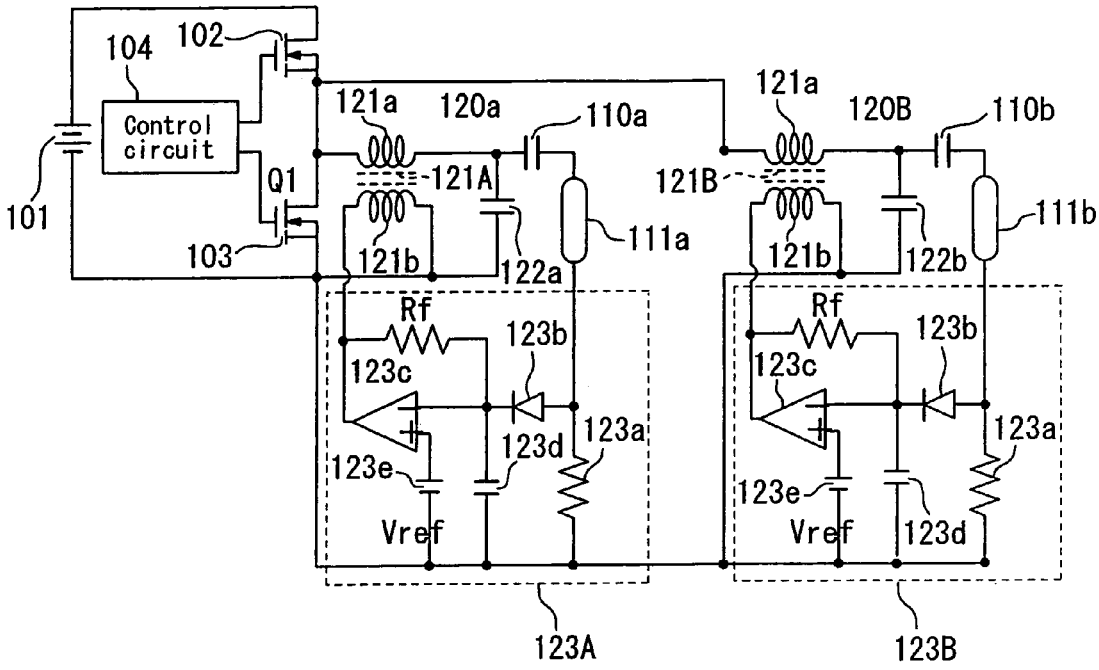
FIG. 3 is a circuitry of a conventional discharge lamp lighting apparatus.

FIG. 2 shows a discharge lamp lighting apparatus 20 according to a second embodiment of the present invention. The discharge lamp lighting apparatus 20 operates in the same way as the discharge lamp lighting apparatus 10 shown in FIG. 10, and therefore description will be focused on the difference from the discharge lamp lighting apparatus 10.

In the discharge lamp lighting apparatus 20, a secondary winding Ns of a step-up transformer 3 is split into two divisional windings 3*a* and 3*b*, and the winding ratio between the two divisional windings 3*a* and 3*b* is changed so as to apply different voltages to discharge lamps 5*a* and 5*b*, thus achieving desired lamp currents IL. In the second embodiment, the discharge lamp lighting apparatus 20 shown in FIG. 2 is to light two discharge lamps as an example, but can light more than two discharge lamps if the secondary winding Ns of the step-up transformer 3 is split into divisional windings in a number corresponding to the number of discharge lamps.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A discharge lamp lighting apparatus comprising:

a DC power supply;

a control circuit;

a step-up transformer defining a primary side and a secondary side; and switching elements connected to the DC power supply and functioning to drive the primary side of the step-up transformer by a signal from the control circuit thereby lighting at least two discharge lamps provided at the secondary side of the step-up transformer, wherein: one terminal of the secondary side of the step-up transformer is connected to one terminal of each of the at least two discharge lamps, and the other terminal of the secondary side of the step-up transformer is grounded; at least two series resonant circuits are each formed by a leakage inductance of the step-up transformer, and capacitors provided between the secondary side of the step-up transformer and each discharge lamp; at least two lamp current detecting units are each connected, via each of at least two variable inductance elements, to the other terminal of each discharge lamp; a signal of each of the at least two lamp current detecting units is connected to each of at least two lamp current control circuits; and an output signal from each lamp current control circuit is connected to each of the variable inductance elements so as to vary the inductance of each variable inductance element, whereby a lamp current flowing through each discharge lamp is controlled.

2. A discharge lamp lighting apparatus according to claim 1, wherein a secondary winding of the step-up transformer is split into at least two divisional windings, and wherein each of the at least two series resonant circuits, each of the at least two variable inductance elements, each of the at least two lamp current detecting units, and each of the at least two lamp current control circuits are provided at each of the at least two divisional windings of the secondary winding.

3. A discharge lamp lighting apparatus according to claim 1, wherein each of the lamp current control circuits includes an operational amplifier and a transistor, a signal from each of the lamp current detecting units and a reference voltage are inputted to the operational amplifier, an output of the operational amplifier is connected to a base terminal of the transistor, and a collector terminal of the transistor is connected to each of the variable inductance elements thereby varying the inductance of each variable inductance element.

4. A discharge lamp lighting apparatus according to claim 1, wherein each of the variable inductance elements constitutes a transformer, and a snubber circuit is connected to both terminals of a control winding of the transformer.

5. A discharge lamp lighting apparatus according to claim 1, wherein the discharge lamp lighting apparatus is incorporated in a backlight device for a liquid crystal display apparatus.

6. A discharge lamp lighting apparatus according to claim 2, wherein each of the lamp current control circuits includes an operational amplifier and a transistor, a signal from each of the lamp current detecting units and a reference voltage are inputted to the operational amplifier, an output of the operational amplifier is connected to a base terminal of the transistor, and a collector terminal of the transistor is connected to each of the variable inductance elements thereby varying the inductance of each variable inductance element.

7. A discharge lamp lighting apparatus according to claim 2, wherein each of the variable inductance elements constitutes a transformer, and a snubber circuit is connected to both terminals of a control winding of the transformer.

8. A discharge lamp lighting apparatus according to claim 3, wherein each of the variable inductance elements constitutes a transformer, and a snubber circuit is connected to both terminals of a control winding of the transformer.

9. A discharge lamp lighting apparatus according to claim 2, wherein the discharge lamp lighting apparatus is incorporated in a backlight device for a liquid crystal display apparatus.

10. A discharge lamp lighting apparatus according to claim 3, wherein the discharge lamp lighting apparatus is incorporated in a backlight device for a liquid crystal display apparatus.

11. A discharge lamp lighting apparatus according to claim 4, wherein the discharge lamp lighting apparatus is incorporated in a backlight device for a liquid crystal display apparatus.

* * * * *